US006502336B2

(12) United States Patent
Pippins

(10) Patent No.: US 6,502,336 B2
(45) Date of Patent: Jan. 7, 2003

(54) APPARATUS AND METHOD FOR COUPLING AN EXCAVATION TOOTH ASSEMBLY

(75) Inventor: Sherlock Pippins, Dallas, TX (US)

(73) Assignee: TRN Business Trust, Dallas, TX (US)

( * ) Notice: Subject to any disclaimer, the term of this patent is extended or adjusted under 35 U.S.C. 154(b) by 0 days.

(21) Appl. No.: 09/921,972

(22) Filed: Aug. 2, 2001

(65) Prior Publication Data

US 2001/0052196 A1 Dec. 20, 2001

Related U.S. Application Data

(63) Continuation of application No. 09/372,156, filed on Aug. 20, 1999, which is a continuation-in-part of application No. 09/286,060, filed on Apr. 5, 1999, now Pat. No. 6,119,378.

(51) Int. Cl.[7] ..... E02F 9/28
(52) U.S. Cl. ..... 37/458
(58) Field of Search ..... 37/452, 453, 454, 37/455, 456, 457, 458, 459; 403/379, 374, 322.2, 328

(56) References Cited

U.S. PATENT DOCUMENTS

| | | | | |
|---|---|---|---|---|
| 1,216,290 A | | 2/1917 | Dickson | |
| 1,419,047 A | | 6/1922 | Hanks et al. | |
| 1,845,677 A | | 2/1932 | Mekeel | |
| 2,064,059 A | | 12/1936 | Fellmeth | 37/142 |
| 2,113,420 A | | 4/1938 | Younie | 37/141 |
| 2,618,873 A | | 11/1952 | Hostetter | 37/142 |
| 2,635,366 A | | 4/1953 | Hostetter | 37/142 |
| 2,689,419 A | | 9/1954 | Daniels et al. | 37/142 |
| 2,934,842 A | | 5/1960 | Van Buskirk | 37/142 |
| 3,498,677 A | | 3/1970 | Morrow | 299/86 |
| 3,787,132 A | | 1/1974 | Garnett | |
| 3,839,805 A | | 10/1974 | Stepe | 37/142 |
| 3,896,569 A | | 7/1975 | Thompson et al. | 37/141 |
| 3,967,399 A | | 7/1976 | Heinold et al. | 37/142 |
| 3,974,579 A | | 8/1976 | Black et al. | 37/141 |
| 3,982,339 A | | 9/1976 | Nilsson | 37/141 |
| 4,067,657 A | | 1/1978 | Kaarlela | 403/317 |
| 4,233,761 A | * | 11/1980 | Ryerson | |
| 4,247,147 A | | 1/1981 | Rettkowski | 299/10 |
| 4,326,348 A | | 4/1982 | Emrich | 37/142 |
| 4,335,532 A | | 6/1982 | Hahn et al. | 37/142 |
| 4,404,760 A | | 9/1983 | Hahn et al. | 37/142 |
| 4,481,728 A | * | 11/1984 | Mulder et al. | |
| 4,587,751 A | | 5/1986 | Sjogren et al. | 37/142 |
| 4,662,762 A | | 5/1987 | Schwarz | |
| 4,663,867 A | | 5/1987 | Hahn et al. | 37/142 |
| 4,716,667 A | | 1/1988 | Martin | 37/142 |
| 4,727,663 A | | 3/1988 | Hahn | 37/142 |
| 4,823,487 A | * | 4/1989 | Robinson | |
| RE33,042 E | | 9/1989 | Emrich | 37/142 |
| 4,895,459 A | | 1/1990 | Werner | |
| 4,941,758 A | | 7/1990 | Osawa | |
| 5,009,017 A | | 4/1991 | Diekevers et al. | 37/142 A |

(List continued on next page.)

OTHER PUBLICATIONS

"Pisilok® Tooth Systems" (one page).
"Torqlok ® System," *Quality Steel Foundries Ltd.* (one page).
"Dragline Products—Hensley Style" (eleven pages).
"Keech Castings Australia PTY. Limited," Aug. 31, 1995 (one page).
"Maglok® System," *Quality Steel Foundries Ltd.*
"Mining Vertalok® Adapters for Shovel Dippers," ©1992 ESCO Corporation. (4 pages).

*Primary Examiner*—Victor Batson
(74) *Attorney, Agent, or Firm*—Baker Botts L.L.P.

(57) ABSTRACT

A system for rapid and easy replacement of sacrificial machine parts, utilizing an adapter having a slot and a retainer pin fitted with at least one spring-loaded ball bearing suitable for engaging the slot when the retainer pin is inserted into the adapter.

4 Claims, 5 Drawing Sheets

U.S. PATENT DOCUMENTS 5,074,062 A * 12/1991 Hahn et al.
5,081,774 A 1/1992 Kuwano ..... 137/142
5,088,214 A 2/1992 Jones ..... 37/141
5,111,600 A 5/1992 Lukavich et al. ..... 37/141
5,152,088 A 10/1992 Hahn ..... 37/142
5,172,501 A 12/1992 Pippins ..... 37/142
5,181,780 A 1/1993 Morita
5,233,770 A 8/1993 Robinson ..... 37/456
5,297,873 A 3/1994 Komiya
5,337,495 A 8/1994 Pippins ..... 37/453
5,361,520 A * 11/1994 Robinson
5,410,826 A 5/1995 Immel et al. ..... 37/457
5,423,138 A 6/1995 Livesay et al. ..... 37/456
5,435,084 A 7/1995 Immel ..... 37/398
5,452,529 A 9/1995 Neuenfeldt et al. ..... 37/455
5,469,648 A 11/1995 Jones et al. ..... 37/457
5,484,210 A 1/1996 Gallone
5,491,915 A 2/1996 Robinson ..... 37/458
5,638,621 A 6/1997 Keech et al. ..... 37/446
5,709,043 A 1/1998 Jones et al. ..... 37/458
5,802,795 A 9/1998 Myers et al. ..... 52/426
5,926,982 A 7/1999 Keech et al. ..... 37/455
5,937,550 A * 8/1999 Emrich
5,947,209 A 9/1999 Halford et al. ..... 172/772.5
5,983,534 A * 11/1999 Robinson et al.
5,992,063 A 11/1999 Mack ..... 37/450
6,000,153 A 12/1999 Sollami ..... 37/453
6,018,896 A 2/2000 Adamic ..... 37/456
6,052,927 A 4/2000 Pippins ..... 37/454
6,092,958 A 7/2000 Gale ..... 403/378
6,108,950 A 8/2000 Ruvang et al. ..... 37/452
6,119,378 A 9/2000 Pippins ..... 37/454
6,151,812 A * 11/2000 Bierwith
6,247,255 B1 6/2001 Clendenning ..... 37/452
6,374,521 B1 4/2002 Pippins ..... 37/456

* cited by examiner

FIG. 5
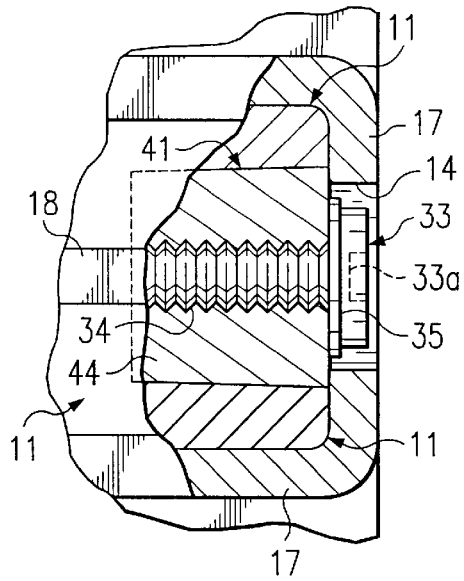
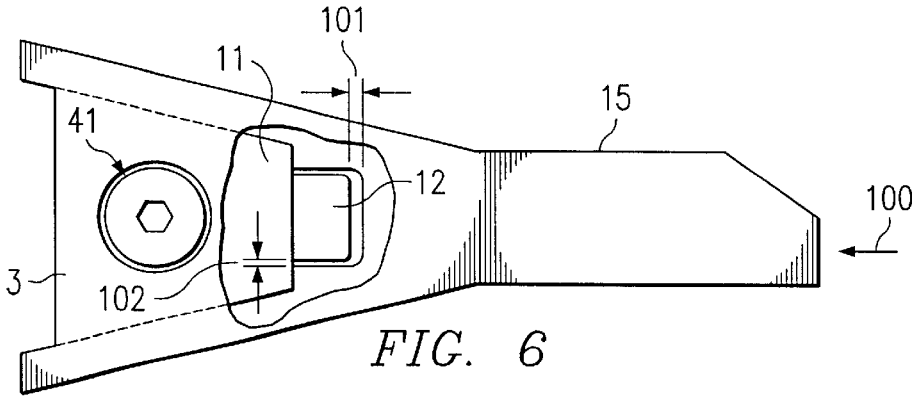
FIG. 6
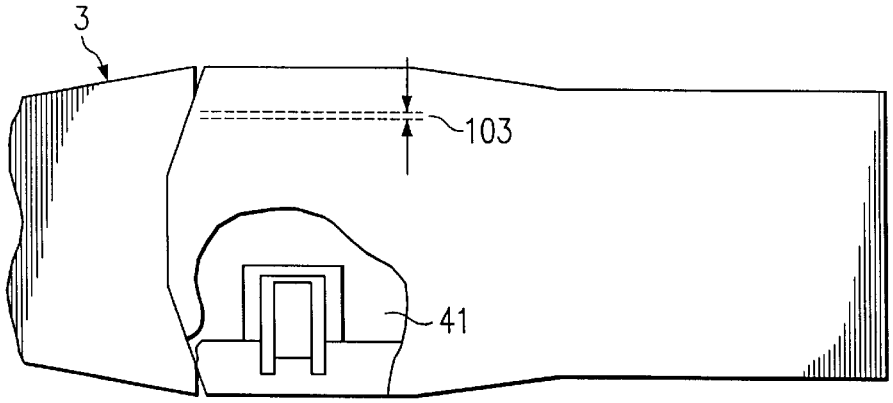
FIG. 7

APPARATUS AND METHOD FOR COUPLING AN EXCAVATION TOOTH ASSEMBLY

RELATED APPLICATION

This application is a continuation of U.S. application Ser. No. 09/372,156 filed Aug. 20, 1999 entitled Apparatus and Method for Coupling an Excavation Tooth Assembly, which is a continuation-in-part of U.S. application Ser. No. 09/286,060 filed Apr. 5, 1999, entitled Replaceable Machine Part Retention System, now U.S. Pat. No. 6,119,378 dated Sep. 19, 2000.

BACKGROUND OF THE INVENTION

1. Field of the Invention

This invention relates to replaceable machine parts that are exposed to high wear and repeated shock loading, such as teeth used on dragline buckets. Specifically, the system of this invention comprises a new and improved retention system permitting easier and quicker changeovers of high-wear replaceable parts.

2. Description of the Prior Art

Digging and levelling apparatus such as draglines, backhoes, front-end loaders and like often use replaceable tooth assemblies which are mounted on the tooth horns to provide sacrificial parts that are exposed to the repeated shock loading and high wear occasioned by the digging operation. In such systems, each tooth assembly typically includes a wedge-shaped adapter which mounts directly on the tooth horn of the bucket, shovel or alternative digging or scraping mechanism of the equipment. A wedge-shaped tooth point is frontally seated on and rigidly pinned to the adapter for engaging the material to be excavated.

Attachment of the tooth point is typically accomplished by means of one or more inserts which are inserted into insert cavities in an adapter. The inserts are internally threaded to accommodate a bolt that secures the tooth to the adapter. Installation and removal of teeth secured using such a system requires substantial time and effort, since the tooth point bolts must be screwed in and unscrewed when the tooth is to be replaced, operations which requires using a powered impact wrench. Moreover, the use of such a tool presents the danger of over-torquing, resulting in damage to the threads and possible personal injury to the operator.

SUMMARY OF THE INVENTION

I have discovered that by using a pin featuring spring-loaded balls along the shank instead of a threaded bolt, along with an insert having one or more internal grooves to accommodate the spring-loaded balls. A pin including such a mechanism can be inserted manually, without tools, and removed quickly and easily using a pair of pliers or a special extraction tool designed to fit a hook built into the pin.

The invention is particularly suited to accomplish quicker and easier replacement of teeth used for excavating equipment such as draglines, bucket wheels, but also is applicable to other types of equipment having sacrificial parts subject to high wear.

It is an object of this invention, therefore, to provide quicker changeovers for sacrificial parts of machines, especially digging equipment.

It is a further object of this invention to provide an improved system for attaching replaceable teeth to drag line buckets and similar equipment.

BRIEF DESCRIPTION OF THE DRAWINGS

FIG. 5 is a partial sectional view of the adapter, tooth point and insert elements of the tooth assembly in assembled configuration as illustrated in FIG. 2;

FIG. 6 is a side view of the tooth assembly showing the locations where specific tolerances are provided according to one embodiment of my invention;

FIG. 7 is a top view of the tooth assembly also showing the locations where specific tolerances are provided according to one embodiment of my invention;

DETAILED DESCRIPTION

I will describe the attachment system of my invention with particular reference to the attachment of replaceable teeth to excavating equipment such as dragline buckets, and more particularly to the assembly disclosed in my U.S. Pat. No. 5,337,495 (issued Aug. 16, 1994) and in my U.S. patent application Ser. No. 09/158,339, filed Sep. 21, 1998 (System and Method for Improving the Service Life of Replaceable Parts Exposed to Shock Loading), the disclosures of which are incorporated by reference herein. Those skilled in the art will understand, however, that my invention also is applicable to other machines using replaceable parts. Examples of such machines include downhole drills and related tools, conveyor belt parts, center wear shrouds and wing shrouds on dragline buckets, track shoes for tracked vehicles, machine gun and artillery breech parts and the like.

Figure 1:
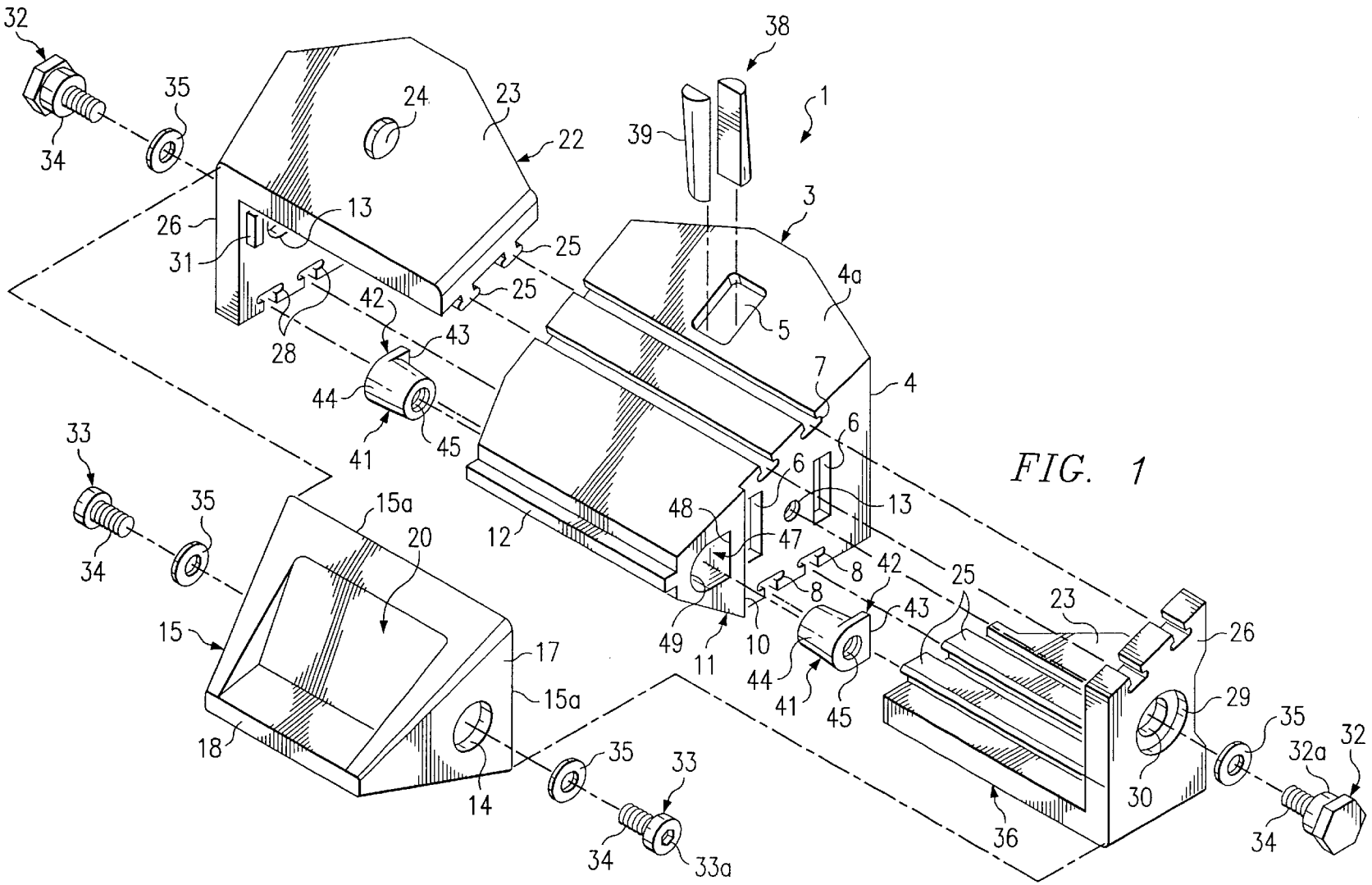
FIG. 1 is an exploded view of a preferred embodiment of the tooth assembly of this invention mounted on a conventional tooth horn of a bucket or shovel of an excavating apparatus.
Figure 2:
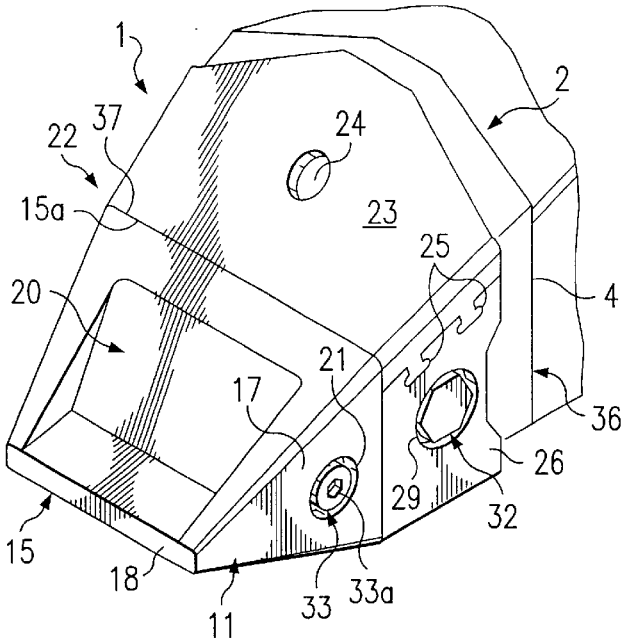
FIG. 2 is a perspective view of the tooth assembly illustrated in FIG. 1 assembled on the conventional tooth horn.
Figure 4:
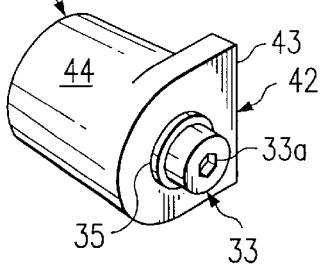
FIG. 4 is a perspective view of an insert element of the tooth assembly illustrated in FIGS. 1–3.

Referring to the drawings and to FIGS. 1 and 2 in particular, the tooth assembly of this invention is generally illustrated by reference numeral 1 and is mounted on a conventional tooth horn 2 of the bucket or shovel of a conventional excavator (not illustrated). The tooth assembly 1 includes a wedge-shaped adapter 3, fitted with a removable tooth point 15, which has a contact edge 18 and is mounted on the adapter 3 by means of a pair of tooth point retainer pins 33, each extending through a tooth point retainer pin opening 14 in the tooth point side wall 17 of the tooth point 15 and threaded in an insert 41, seated in opposite sides of the adapter 3. In a preferred embodiment, the tooth assembly 1 further includes a transversely-mounted top wear cap 22 and bottom wear cap 36, both of which are also bolted to the adapter 3 by means of side plate bolts 32, respectively. In a most preferred embodiment of the invention the adapter 3 includes a wedge-shaped adapter base 4 which tapers from a base plate 4*a* to a nose ridge 12, terminating the adapter nose 11. A base plate lock opening 5 is provided in the base plate 4*a* of the adapter base 4 for receiving a spool 38 and a companion wedge 39 and mounting the adapter 3 on the tooth horn 2 in conventional fashion. A pair of transverse, vertically-oriented, spaced stabilizing slots 6 are provided in the sides of the adapter base 4, for purposes which will be hereinafter further described. Spaced, parallel top rib slots 7 are also provided transversely in the top tapered face of the base plate 4*a* of the adapter base 4 and in a most preferred embodiment, the top rib slots 7 are T-shaped, as illustrated in the drawings. Similarly, a pair of spaced, T-shaped bottom rib slots 8 are provided in the bottom tapered surface or face of the adapter base plate 4*a* in the same relative position as the top rib slots 7. It is understood that the top rib slots 7 and bottom rib slots 8 may alternatively be shaped in a "dove-tail", or alternative locking configuration, according to the knowledge of those skilled in the art.

Figure 3:
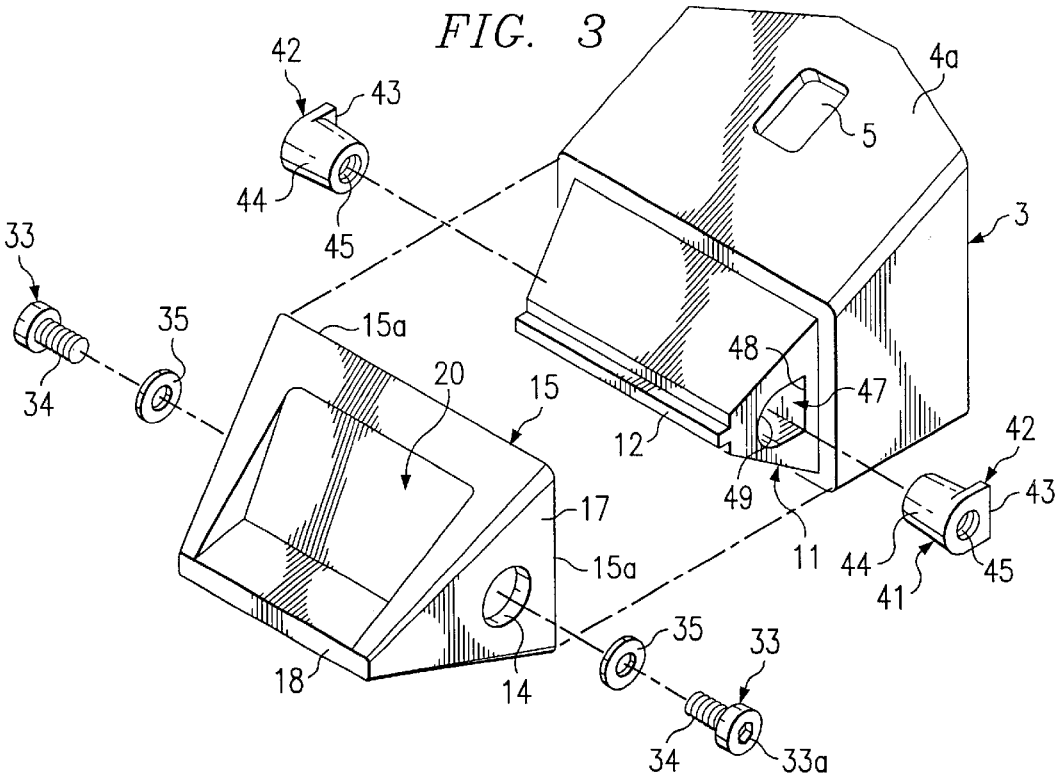
FIG. 3 is an exploded view of the adapter and tooth point elements of the tooth assembly illustrated in FIGS. 1 and 2 in a second preferred embodiment.

As further illustrated in FIG. 1, the top wear cap 22 and bottom wear cap 36 are designed to slidably mount transversely on the adapter base 4 of the adapter 3. The L-shaped top wear cap 22 and bottom wear cap 36 are each characterized by identical cap plates 23 and corresponding side plates 26 and are therefore interchangeable. The cap plate 23 of the top wear cap 22 further includes a cap plate opening 24, which registers with the base plate lock opening 5 located in the adapter 3, to provide access to the spool 38 and wedge 39 for readily tensioning the wedge 39 if necessary, as illustrated in FIG. 1. A pair of spaced, T-shaped cap plate ribs 25 are transversely located in the bottom surface of the cap plate 23 of the top wear cap 22 and are designed to register with the spaced top rib slots 7 provided in the adapter 3. Similarly, additional cap plate ribs 25 are provided in spaced relationship in the top surface of the cap plate 23 of the bottom wear cap 36 for registering with corresponding spaced parallel bottom rib slots 8, located in the bottom face of the adapter 3, also as illustrated in FIG. 1. A side plate retainer pin opening 30 is provided in each of the side plates 26 of the top wear cap 22 and the bottom wear cap 36 for receiving the side plate bolts 32, respectively, in order to lock the top wear cap 22 on the top and one side of the adapter 3 and the bottom wear cap 36 on the bottom and opposite side of the adapter 3, as illustrated in FIG. 2. As further illustrated in FIGS. 1 and 2 of the drawings, the adapter 3 is fitted with an adapter recess 10 on one side to facilitate recessing of the side plate 26 of the bottom wear cap 36 and extension of the corresponding cap plate ribs 25, located in the bottom surface of the cap plate 23 of the top wear cap 22, into the corresponding side plate slots 28, provided in the extending end of the side plate 26 of the bottom wear cap 36. Similarly, the projecting cap plate ribs 25, located in the cap plate 23 of the bottom wear cap 36, project in registration with the corresponding side plate slots 28, located in the extending end of the side plate 26 of the top wear cap 22 when the top wear cap 22 and bottom wear cap 36 are assembled and interlocked on the adapter 3, as illustrated in FIG. 3. A side plate recess 29 is provided in the side plate 26 of each of the top wear cap 22 and bottom wear cap 36 and surrounds a corresponding side plate retainer pin opening 30, to accommodate the head of the side plate bolts 32 in countersunk, recessed relationship. Furthermore, spaced side plate lugs 31 are provided in the side plate 26 of the top wear cap 22 and bottom wear cap 36 for registering with the corresponding spaced stabilizing slots 6, located in the sides of the adapter 3, respectively. Accordingly, it will be appreciated by those skilled in the art that when the top wear cap 22 and bottom wear cap 36 are mounted on the adapter 3 from opposite sides, with the respective cap plate ribs 25 engaging corresponding top rib slots 7 and bottom rib slots 8 located in the bevelled top and bottom faces of the adapter base 4*a,* respectively, the top wear cap 22 and bottom wear cap 36 are interlocked as illustrated in FIGS. 1 and 2. Furthermore, insertion of the side plate bolts 32 through the respective side plate retainer pin openings 30 in the side plates 20 26 of the top wear cap 22 and bottom wear cap 36, respectively, and threading of the side plate bolts 32 in the respective threaded openings 13 located in the sides of the adapter 3, locks the top wear cap 22 and bottom wear cap 36 securely on the adapter 3, with the side plate lugs 31 engaging the corresponding stabilizing slots 6 located in the adapter 3. The top wear cap 22 and bottom wear cap 36 are thus prevented from disengaging the adapter 3 without removing the side plate bolts 32. Moreover, the heads of the side plate bolts 32 are securely recessed inside the respective side plate recesses 29, provided in the side plates 26, to minimize the possibility of shearing the side plates retainer pins 32 from the tooth assembly 1.

In another preferred embodiment of the invention each of the side plate bolts 32 is provided with a retainer pin shoulder 32*a* located beneath the head thereof. However, in a most preferred embodiment of the invention the heads of the respective side plate bolts 32 are spaced from the recess shoulder 29*a* of each side plate recess 29. This spacing facilitates limited movement of the top wear cap 22 and bottom wear cap 36 with respect to the adapter 3 as described in my U.S. Pat. No. 5,172,501 and serves as a stress-relieving function to minimize damage to the tooth assembly 1 by operation of the excavation or levelling equipment upon which the tooth assembly 1 is mounted.

Figure 8:
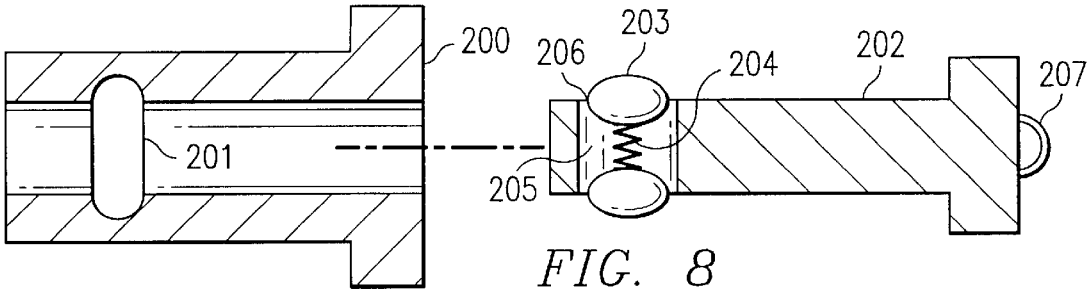
FIG. 8 is a sectional view of the improved insert and pin using spring-loaded ball bearings.
Figure 9:
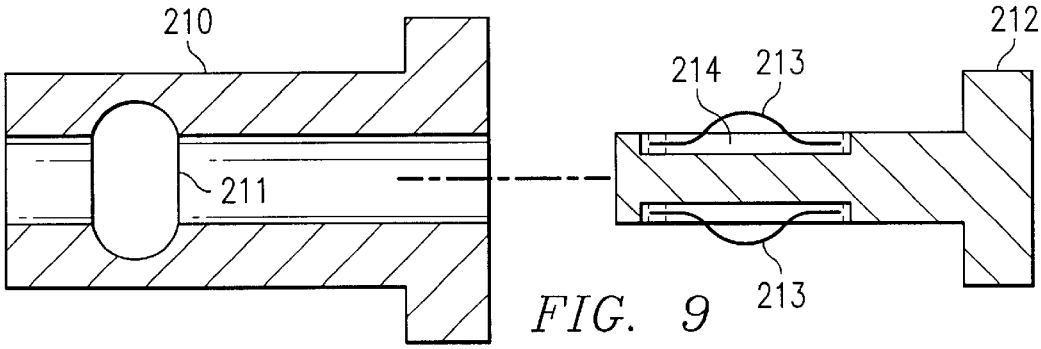
FIG. 9 is a sectional view of an alternate embodiment of the improved pin utilizing springs.

Referring now to FIGS. 1 and 3–5 of the drawings, the tooth point 15 is removably attached to the adapter 3 by means of two tapered inserts 41, each inserted in a correspondingly-shaped insert cavity 47, provided in the wedge-shaped tooth point side walls 17 of the adapter 3. Each insert 41 includes an insert bore 45, extending through a tapered, rounded insert body 44 which terminates in an insert shoulder 42, having a straight shoulder edge 43. The respective oppositely-disposed insert cavities 47 are tapered and shaped to define a cavity shoulder 48, which engages the insert shoulder 42, and a body curvature 49, which engages the insert body 44. Accordingly, the insert cavities 47 removably receive the inserts 41 and prevent the inserts 41 from rotating when pressure is applied to the tooth point retainer pins 33, which secure the tooth point 15 on the adapter 3. When the preferred retainer pins of FIGS. 8 and 9 are used, lockwasher 35 is preferably omitted. Optionally, when the retainer pins of FIGS. 8 and 9 are used, the insert 41 may not require an insert shoulder that is shaped to prevent rotation.

Those skilled in the art will understand that various shapes can be used for insert 41, such as square, circular, star-shaped and the like.

Accordingly, referring again to FIGS. 1 and 2, the tooth point 15 is designed to mount frontally on the adapter nose 11 of the adapter 3 by matching the tooth point retainer pin openings 14, located in the opposite tooth point side walls 17 of the tooth point 15, with the corresponding insert bores 45, provided in the inserts 41. Each tooth point retainer pin 33 is then registered with a corresponding tooth point retainer pin opening 14 and the shank of each tooth point retainer pin 33 is inserted into the corresponding insert bore 45 located in the insert 41, to removably secure the tooth point 15 on the adapter 3. When the tooth point 15 is so inserted on the adapter 3, the tooth point edge 15*a* is located in close proximity to the corresponding edges of the cap plates 23 and side plates 26 of the top wear cap 22 and bottom wear cap 36, respectively, as illustrated in FIG. 2. However, a working gap 37 is maintained between the tooth point edge 15*a* of the tooth point 15 and the front edges of the top wear cap 22 and bottom wear cap 36, respectively, to facilitate movement of the tooth point 15 and top wear cap 22, as well as the bottom wear cap 36, with respect to the adapter 3. As illustrated in FIG. 5, since the diameter of the tooth point retainer pin opening 14 is smaller than the external dimensions of the inserts 41 at the insert shoulder 42, the inserts 41 cannot exit the respective insert cavities 47 through the tooth point retainer pin openings 14. However, the inserts 41 can be easily removed from the insert cavities 47 when the teeth are removed from the adapter 3. Accordingly, the tooth point 15 is afforded a range of movement on the adapter nose 11 due to the space between the heads of the tooth point retainer pins 33 and the periphery of the tooth point retainer pin openings 14, as well as the working gap 37, to relieve digging stresses.

It will be appreciated from a consideration of the drawings that the tooth assembly of this invention exhibits multiple favorable structural characteristics not found in conventional assemblies. The interlocking relationship between the top wear cap 22 and bottom wear cap 36, along with the transverse, slidable mounting of these structural members and the removable mounting of the tooth point 15 on the adapter 3, facilitate an extremely strong, versatile wear-resistant assembly. Furthermore, recessing of the respective side plate bolts 32 and tooth point retainer pins 33, as well as the side plates 26 of the top wear cap 22 and the bottom wear cap 36 provided in opposite sides of the adapter 3, facilitate excavation and levelling of all types of material without fear of shearing the respective side plate bolts 32 and tooth point retainer pins 33. Moreover, use and replacement of the top wear cap 22, bottom wear cap 36 and tooth point 15 independently or in concert, is quickly and easily facilitated in an optimum manner by simply removing the side plate bolts 32 and tooth point retainer pins 33, sliding the top wear cap 22, bottom wear cap 36 and tooth point 15 from the adapter 3 and replacing these members by reversing this procedure. Shock and impact resistance of the tooth assembly 1 is facilitated by mounting the top wear cap 22 and bottom wear cap 36 and tooth point 15 in a non-rigid, but secure relationship on the adapter 3 to facilitate a selected minimum movement of the top wear cap 22, bottom wear cap 36 and tooth point 15 with respect to the adapter 3 during operation. Use of the inserts 41 to mount the tooth point 15 on the adapter 3 facilitates quick and easy removal and replacement of the tooth point 15 without risk of cross-threading a tooth point bolt directly into tapped holes provided in the adapter 3. Such tapped holes are subject to various types of damage and the inserts 41 are capable of easy replacement to avoid this problem. A tooth assembly 1 is mounted on each tooth horn 2 of a conventional bucket or shovel of a conventional excavating apparatus in conventional manner, utilizing the spool 38 and wedge 39, according to the knowledge of those skilled in the art. It will be appreciated that alternative means for mounting the tooth assembly 1 to the tooth horn of such equipment may also be implemented without departing from the spirit and scope of the invention as embodied herein.

FIG. 6 and FIG. 7 illustrate the specific tolerances of my invention. FIG. 6 shows a preferred embodiment of my invention as applied to a replaceable tooth point 15 for a dragline bucket. In the side view of FIG. 6, the removable tooth point 15 is shown attached to the wedge-shaped adapter 3, held loosely in place by insert 41. The approximate direction of the heaviest shock load is shown at reference numeral 100. As shown in the following examples, I have found that providing the following clearances between the sacrificial part (the removable tooth point 15, in this example) and the adapter 3 upon which it is mounted will effectively and surprisingly increase the life of the sacrificial part:

Horizontal clearance at reference numeral 101 in approximate direction of shock: about 1/8 inch to about 1/4 inch.

Vertical clearance at reference numeral 102 normal to approximate direction of shock: about 1/32 inch to about 3/16 inch; preferably about 1/16 inch to about 1/8 inch.

Horizontal clearance at reference numeral 103 normal to approximate direction of shock: about 1/32 inch to about 1/16 inch.

I find that if larger clearances are used the teeth will tend to move forward and contact the bolts, causing failure by bending or fracture; whereas if smaller clearances are used there will be interference from the castings, notably between the adapter 3 and the sacrificial part 15.

Figure 10:
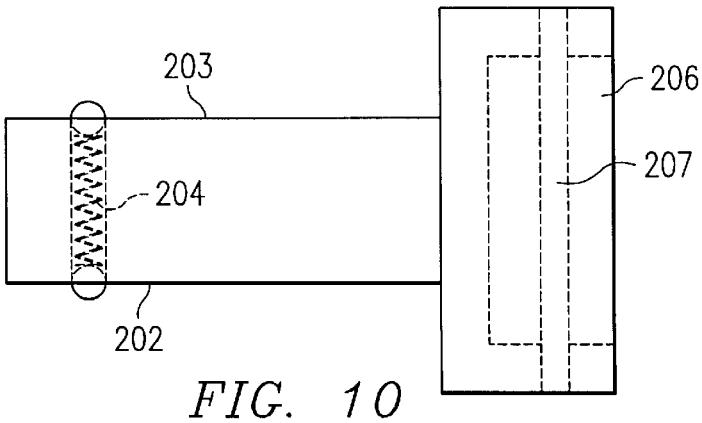
FIG. 10 is a detail showing one possible arrangement of a bar-type hook recessed into the head of a retaining pin.
Figure 10A:
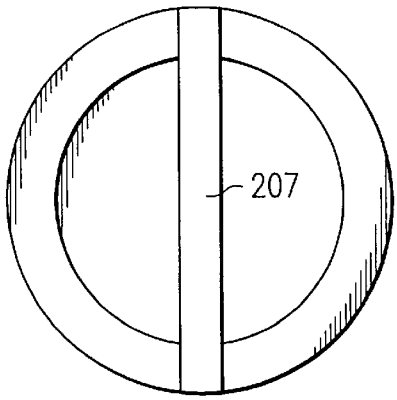
Figure 11:
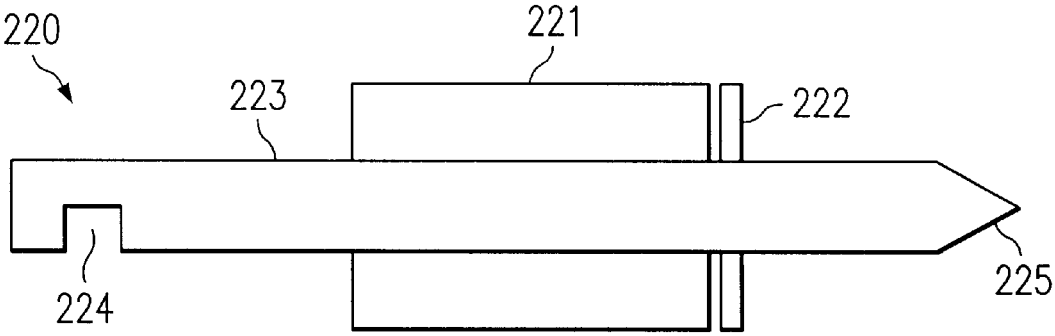
FIG. 11 illustrates an extraction tool that can be used to remove the improved retaining pin of this invention.

FIG. 8 illustrates a preferred embodiment of my invention in which the tooth point retainer pin 202 is not threaded, but instead is fitted with a cavity 205 containing at least one spring-loaded ball bearing 203 and a spring mechanism 204 which urges the ball bearing 203 radially outwardly as far as permitted by the hole 206 in the shank of the insert pin 202. The corresponding insert 200 includes an internal slot or depression 201 suitable for accommodating the one or more ball bearings 203. When the retainer pin 202 is inserted into the cavity of the insert 200, the ball bearings 206 retract until they reach the internal slot 201, at which point the spring mechanism 206 forces the ball bearings 203 radially outward into the slot 201, securing the retainer pin 202 in the insert 200. This operation preferably is accomplished manually without need for tools. To remove the retainer pin 202, a pair of pliers may be used, or if the retainer pin 202 is designed to be flush or recessed, an extractor tool (not shown) suitable for engaging a hook 207 on retainer pin 202 may be used to remove the retainer pin 202. Preferably, hook 207 is arranged as shown in FIG. 10, with the hook formed as a bar recessed in a cavity 226 in the head of the retaining pin to protect it from dirt and wear. FIG. 11 shows an extraction tool 220 comprising a shaft 223 on which a sliding weight 221 moves longitudinally. The distal end of the shaft includes a recess 224 suitable for engaging the hook or bar 207 that is recessed into the retaining pin shown in FIG. 10. A stop 222 near the proximal end of the extraction tool permits the sliding weight to act as a slide hammer to dislodge retaining pin 202. Optionally, the proximal end 225 of the extraction tool can be pointed so that it can be used to clean out the cavity 226 before engaging the bar 207 with the recess 224 near the distal end of the shaft of the extraction tool.

In any event, tooth retention is achieved without need for threading and unthreading a bolt.

FIG. 9 illustrates an alternative embodiment, in which instead of ball bearings, one or more springs 213 set into cavities 214 are used to retain the retainer pin 212 in the insert 210 by engaging slots 211.

Figure 12:
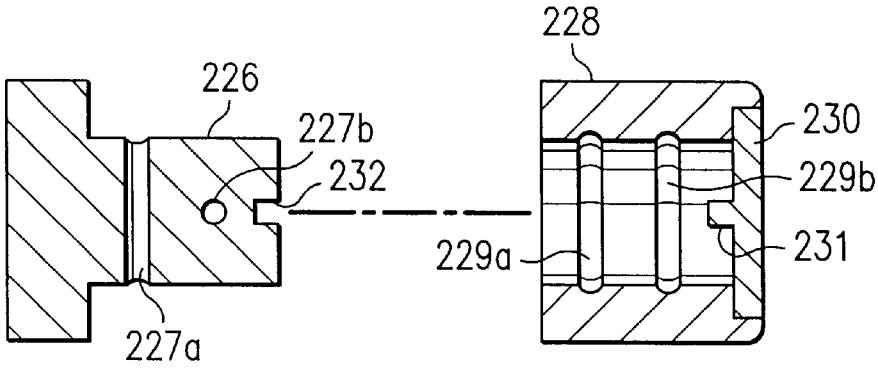
FIG. 12 is a sectional view of a second arrangment of the improved insert in which the pin is non-rotatable.

FIG. 12 illustrates another preferred embodiment of my invention in which the tooth point retainer pin 226 is not threaded, but instead is fitted with one or more cavities 227*a* and 227*b* containing at least one spring-loaded ball bearing or pin and a spring mechanism which urges the ball bearing or pin radially outwardly as far as permitted by the hole 227*a* or 227*b* in the shank of the insert pin 202. The corresponding insert 228 includes one or more internal depressions 229 suitable for accommodating the one or more ball bearings or pins 203. When the retainer pin 226 is inserted into the cavity of the insert 228, the ball bearings or pins retract until they reach the internal depressions 229, at which point the spring mechanism forces the ball bearings or pins radially outward into the depressions 229*a* or 229*b,* securing the retainer pin 226 in the insert 228. In addition, it has been found that it is desirable to prevent rotation of the retainer pin 226 in the insert 228 because during use, if the retainer pin rotates, it may cause the ball bearings or pins to work back into their slots, permitting the retainer pin to come free of the insert. Accordingly, the embodiment of FIG. 12 includes a non-rotation device 230, which preferably may comprise a cap 230 with a transversely-extending ridge 231 that mates with a transversely-extending slot 232 in the base of the retainer pin 226 when the retainer pin 226 is fully seated in the insert 228. It will be recognized that other arrangements of non-rotation devices are possible, so long as the goal of preventing rotation of the retainer pin relative to the insert is accomplished.

It will be understood that the arrangements of springs or ball bearings and slots illustrated in FIGS. 9, 10 and 12 can be reversed if desired, so that the spring or springs are placed in the adapter and the mating slot is in the retainer pin.

In addition, the insert can be eliminated altogether by machining an aperture and slot directly into the adapter nose 11 in the insert cavity 49.

EXAMPLES

In a test comparing dragline bucket teeth attached to a 90 cubic yard dragline bucket according to my invention with conventional, rigidly-attached dragline bucket teeth, the teeth attached according to my invention exhibited an average life of approximately 161 hours compared to 79 hours for the conventionally-attached teeth. The adapter used with the non-rigid attachment system of my invention exhibited an average life of approximately 1655 hours compared to 1113 hours for the adapter using conventional, rigid attachment to the teeth.

In another test at a Phelps-Dodge mine, the rate of tooth wear using my non-rigid attachment system on a dragline bucket was approximately 0.75 inches per 24 hour period, approximately half the rate of wear for conventional, rigid attachment of the teeth.

Those skilled in the art will appreciate that increasing the life of the sacrificial parts not only saves money for replacement parts themselves, but also reduces maintenance downtime and labor costs for parts replacement.

I claim:

1. A tooth assembly, comprising:

an adapter having first and second tapered surfaces, and first and second sides, the first and second tapered surfaces converging toward a first end of the adapter;

a tooth point coupled with the adapter at the first end, the tooth point having a contact edge opposite the first end of the adapter;

a second end of the adapter adapted to be removably coupled with a tooth horn;

the first side of the adapter including a portion which defines an internal bore extending at least partially therethrough, the portion adapted to receive a retainer pin;

the portion further defining a first internal slot extending from the internal bore, the first internal slot configured to receive a detent member associated with the retainer pin; and wherein the portion of the first side of the adapter comprises a removable insert adapted to be received within a cavity defined by the first side, the cavity having a complementary shape to the insert, and wherein the insert defines the central bore.

2. The tooth assembly of claim 1, wherein a side of the tooth point defines at least one opening configured to receive the retainer pin, and wherein the side of the tooth point is configured to secure the insert within the cavity of the adapter.

3. The tooth assembly claim 2, further comprising:

the retainer pin; and wherein the retainer pin extends through the opening and at least partially through the internal bore, the detent member engaging the internal slot and forming a removable coupling between the tooth point and the adapter.

4. A tooth assembly, comprising:

an adapter having first and second tapered surfaces, and first and second sides, the first and second tapered surfaces converging toward a first end of the adapter;

a tooth point coupled with the adapter at the first end, the tooth point having a contact edge opposite the first end of the adapter;

a second end of the adapter adapted to be removably coupled with a tooth horn;

the first side of the adapter including a portion which defines an internal bore extending at least partially therethrough, the portion adapted to receive a retainer pin;

the portion further defining a first internal slot extending from the internal bore, the first internal slot configured to receive a detent member associated with the retainer pin; and comprising a non-rotation ridge extending at least partially into the internal bore, the ridge operable to engage a second slot defined by a base of the retainer pin, to prevent rotation of the retainer pin relative to the adapter.

* * * * *